US005343596A

United States Patent [19]

Kaldor

[11] Patent Number: 5,343,596

[45] Date of Patent: Sep. 6, 1994

[54] INCLINED ROTATABLE DRUMS AND METHOD FOR GRADING FIBROUS MATERIAL

[75] Inventor: Andrew F. Kaldor, Dover Heights, Australia

[73] Assignee: Ankal Pty. Limited, Sydney, Australia

[21] Appl. No.: 700,587

[22] Filed: May 15, 1991

[30] Foreign Application Priority Data

Jan. 29, 1991 [AU] Australia ..... PK4363

[51] Int. Cl.[5] ..... D01B 1/38; B07B 1/24

[52] U.S. Cl. ..... 19/24; 209/240; 209/291

[58] Field of Search ..... 19/5 R, 5 A, 6, 8, 10, 19/24, 34, 35; 209/240, 242, 274, 284, 288, 289, 362, 391, 294; 99/520, 521, 522

[56] References Cited

U.S. PATENT DOCUMENTS

| | | | |
|---|---|---|---|
| 310,335 | 1/1885 | Tracy | 209/289 |
| 1,239,667 | 9/1917 | Brolin | 19/5 R |
| 1,460,176 | 6/1923 | Richardson | 209/289 |
| 1,983,454 | 12/1934 | Haynes | 19/24 X |
| 2,173,314 | 9/1939 | Rylander | 29/294 X |
| 2,222,793 | 11/1940 | Burkardt | 19/24 |
| 2,452,533 | 10/1948 | Wells | 19/5 R |
| 2,721,035 | 10/1955 | Lankford et al. | 209/284 X |
| 2,836,299 | 5/1958 | Johnson | 209/289 X |
| 3,186,649 | 6/1965 | Haltof | 209/284 X |
| 3,464,877 | 9/1969 | Miller et al. | 19/34 X |
| 3,532,276 | 10/1970 | Dunn | 241/77 |
| 3,567,188 | 3/1971 | Cooper et al. | 209/284 X |
| 4,136,832 | 1/1979 | Morita et al. | 209/294 X |
| 4,140,629 | 2/1979 | Martindale | 209/240 |
| 4,231,136 | 11/1980 | Villavicencio | 19/8 X |
| 4,261,816 | 4/1981 | Beck et al. | 209/284 |
| 4,282,090 | 8/1981 | Hoernschemeyer et al. | 209/291 |
| 4,472,272 | 9/1984 | Capannoli | 209/294 X |
| 4,547,263 | 10/1985 | Quame | 19/8 X |

FOREIGN PATENT DOCUMENTS

| | | | |
|---|---|---|---|
| 8813415 | 4/1990 | France . | |
| 2021908 | 5/1987 | Japan | 19/5 R |
| 0603714 | 4/1978 | U.S.S.R. | 19/5 R |
| 1326635 | 7/1987 | U.S.S.R. | 19/5 R |
| 0716093 | 9/1954 | United Kingdom | 19/24 |
| 980698 | 1/1965 | United Kingdom . | |
| 2107217 | 4/1983 | United Kingdom . | |
| 8803444 | 5/1988 | World Int. Prop. O. . | |

*Primary Examiner*—Clifford D. Crowder
*Assistant Examiner*—Ismael Izaguirre
*Attorney, Agent, or Firm*—Ladas & Parry

[57] ABSTRACT

A separator for the separation of fibrous bark from core material of chopped or crushed stalks of a crop such as Kenaf having two or more hollow bodies for rotation on inclined axes, each having a perforated wall and upper inlet and lower outlet ends. Within at least one of the bodies is provided a plurality of longitudinally extending, circumferentially spaced baffles. With rotation of each body while downwardly inclined from the inlet to the outlet, a fibrous phase of the material is conveyed in turn to discharge from the outlet end of one body and conveyed into the inlet of another body, while a more solid phase is discharged through the perforated walls of the bodies.

13 Claims, 2 Drawing Sheets

INCLINED ROTATABLE DRUMS AND METHOD FOR GRADING FIBROUS MATERIAL

BACKGROUND OF THE INVENTION

1. Technical Field

This invention relates to a method and apparatus for the separation of dry material into distinct phases, and more particularly for the separation of fibrous bark from core material of chopped or crushed stalks of a crop such as Kenaf.

2. Background Art

The Kenaf plant is composed of stalks having a fibrous bark and core. The former possesses long fibres capable of producing a high quality paper pulp, while the latter is of lesser quality short fibre composition. In some areas of the world the process of recovering the bark fibre comprises cutting and bundling the stalks, which are then dried in the field and then petted with the bark fibre being scutched from the central woody stem. This is a time-consuming task and the bark fibre that is obtained is not optimum for paper pulping.

Proposals have been made for machine processing of the harvested stalks and this has entailed firstly crushing, grinding or chopping the stalks, and subsequently separating the bulk material into separate phases. A modified form of sugar cane crushing mill has been used for the first stage of processing, while in another instance a forage harvester has been used to gather the crop for baling in a finely chopped condition. However, it has not been possible to achieve high quality grading with conventional separation apparatus.

SUMMARY OF THE INVENTION

It is the main object of the invention to provide a method and apparatus for grading fibrous material which is cost efficient and achieves a high degree of separation of the phases of the material.

In accordance with one embodiment of the invention there is provided an apparatus for grading fibrous material comprising two or more hollow bodies for rotation on inclined axes, each having a perforated wall and upper inlet and lower outlet ends, and a plurality of longitudinally extending, circumferentially spaced baffles within at least one of said bodies, whereby with rotation of each body while downwardly inclined from said inlet to said outlet ends a fibrous phase of the material is conveyed in turn to discharge from the outlet end of one body and conveyed into the inlet of another body, while a more solid phase is discharged through said perforated walls of the bodies.

According to a second embodiment of the invention, there is provided a fibre separator comprising two or more perforated separator bodies, each comprising a cylindrical enclosure rotatable about an inclined axis; each enclosure having an inlet at an upper end and an outlet at a lower end; the outlet of a first body feeding a conveyor which discharges into the inlet of a second body; at least one of the bodies having at least one internal longitudinal baffle, the baffle extending radially inwardly from an internal surface of the body.

Preferably, the baffle is formed from wire mesh.

In a preferred embodiment, at least one of the bodies is located concentrically within a secondary perforated cylindrical enclosure.

Preferably, the secondary enclosure and the separator body within it define a gap space which discharges through an opening located on a lower imperforate end wall which supports the concentric enclosures.

According to a further aspect of the invention, there is provided a method of separating fibres, comprising the steps of:

loading an unseparated mass into an inlet of a first, inclined, perforated, cylindrical separator body;

rotating the first with the mass in it;

collecting a remainder of the mass from an interior of the first body;

conveying the remainder to an inlet of a second, inclined, perforated cylindrical separator body;

rotating the second body with the remainder in it; and collecting a discharge from an interior of the second body;

wherein in at least one of the bodies there is located at least one longitudinal baffle extending from an internal surface.

BRIEF DESCRIPTION OF THE DRAWINGS

The invention will be described in more detail with reference to the accompanying drawings, in which.

DESCRIPTION OF THE PREFERRED EMBODIMENTS

Figure 1:
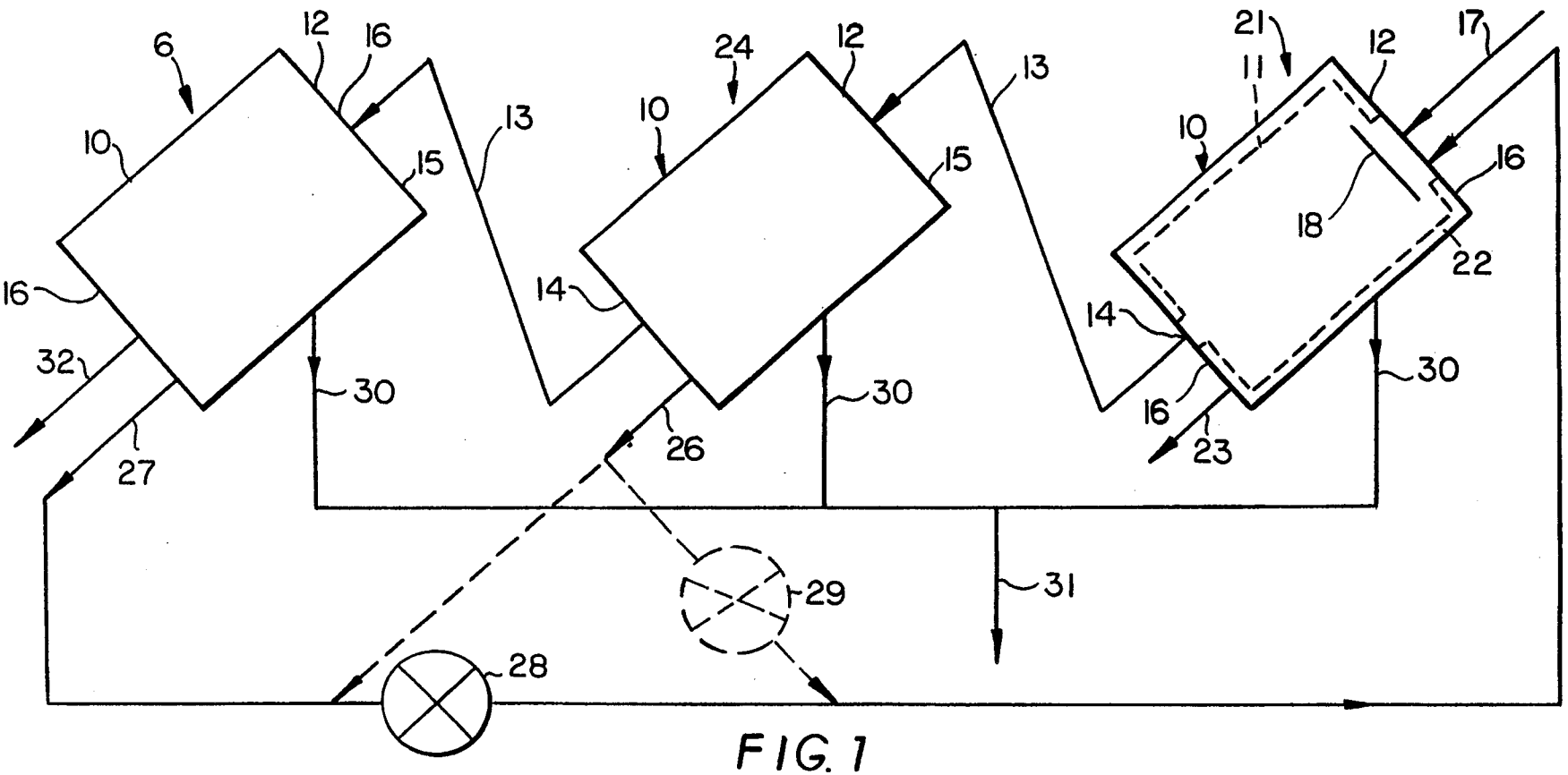
FIG. 1 is a side schematic elevation, of a separation apparatus according to this invention.
Figure 2:
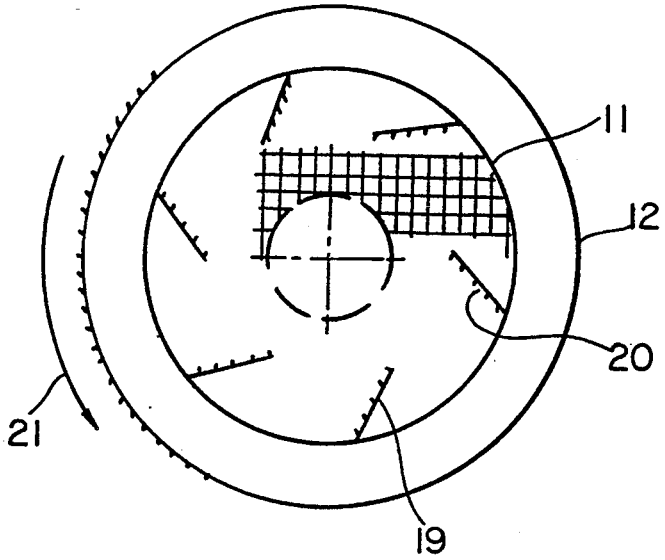
FIG. 2 is a diagrammatic representation in end elevation of a hollow body.

A preferred embodiment is shown in the drawings, and with reference to FIGS. 1 and 2 it will be seen that the separation apparatus of this invention consists of two or more hollow, cylindrical, perforated bodies 10. The bodies may be supported upon a frame. Each body 10 may be enclosed by a housing preferably provided with a removable top cover.

The perforated rotating bodies 10 consists of a perforated or mesh inner cylinder 11 within the length of the body 10 and includes an outer cylindrical wall 12 composed of steel mesh. As represented in the drawings three separate bodies 10 are preferably provided. Communication between bodies 10 is effected through conveyors 13 which extend from the output 14 of one body to the inlet 15 of another. Imperforate, annular plates 16 enclose the opposite ends of each body 10. Bulk material input, under air pressure may be applied via ducting 17 or conveyor 13 through the central opening in an end plate 16 to impinge upon an internal deflector plate 18 from where it is outwardly deflected onto the perforated wall of an inner cylinder 11. A discharge duct, which is preferably imperforate, may be secured to a central opening in the discharge end plate. It is envisaged that two, or even more, similar outer cylinders, concentric with each other and of different diameters, may be incorporated to enhance separation in some instances.

Within one or more of the perforate inner cylinders 11 are fixed, flat, rectangular baffles 19, comprising steel mesh of say 5 cm×5 cm gauge, spaced circumferentially and internally around each of the inner cylinders 11, and, for example, extending the full length of each. The disposition of the baffles 19 within any cylinder is more clearly represented in FIG. 2, where six baffles 19 are shown secured along one of their sides to the interior of the perforate cylinder 11 with the broad face 20 of each forwardly inclined from a radial alignment with the axis of the body 10, as viewed in respect of the direction of its rotation as indicated by the arrow 21.

When a bulk of crop, such as Kenaf, which has been pulverised, crushed, or chopped, is to be supplied to the apparatus for separation into separate phases, it will be preferably transported to the site in the form of bales which are then advanced upon a conveyor to bale-breaking apparatus, which via rotating shredders discharge a continuous stream of bulk crop into ducting which is blown by a motorised fan into the entry 17 to the first rotatable body. In one instance the body 10 has been inclined at a downward angle of about 20 degrees and caused to rotate about its axis at a speed of 24 revolutions per minute. Although, the inclination of 20 degrees is preferred, rotation speeds of from 10 to 35 revolutions per minute could be employed. As a result the baffles 19 impart a tumbling action to the bulk material within the first and/or other compartments. Due to the forward inclination of the baffles 19 the material is carried to its maximum height before being allowed to fall under gravity during rotation of the cylinders. In one instance the inclination of the baffles is approximately 35 degrees, but this is not a strict requirement.

The bulk material of Kenaf in a compartment is generally composed of three phases, firstly a mixture of relatively fine particles of core material and fibrous bark material, as well as a relatively small quantity of large chunks of core material. The larger particles will readily separate from the bark fibre and pass through the mesh of the inner perforate cylinder 11 from where it will travel down the inside 22 of the outer cylinder to be discharged to fall through a lower opening 23 onto a conveyor. Further similar separation occurs in succeeding bodies 24, 25 for discharge of large core particles at other positions 26, 27 onto the discharge conveyor. As this phase of the bulk material is undesirable for pulping, it may be returned to the bale-breaker via the conveyor, or to other pulverising machinery, for subsequent re-input to the separation apparatus. A single rotary Knife or chopper 28 may be used to process this discharge prior to re-input. In the alternative each discharge 23, 26, 27 may be provided with an individual rotary Knife or chopper 29.

Due to the elevation via the baffles within the inner cylinder the bark fibre admixed with fine particles of core material is separated into two phases principally during falling of the admixture under gravity. The small core particles pass through the mesh of both the inner and outer cylinders and is gathered within the respective sections 30 of the housings. This output 31 is, therefore, pure relatively fine particles of Kenaf core material suitable for paper pulping.

Due to the inclination of the bodies 10 and the conveyors 13 the bark fibre is advanced until it is discharged from the main outlet duct 32 as pure, high quality fibre. The more bodies 10 provided, the greater purity of the recovered fibre, but it is believed that three-stage separation, as shown In FIG. 1, is effective to obtain acceptable quality of phases without over complication of the structure. Any suitable conveyor or storage hopper may be utilised for collection of the discharged bark fibre phase.

In some instances choking of the space between the cylinders 22 may occur, and to prevent this, and also to assist in separation of the two principal phases, fans may be provided in the housing to direct air substantially radially and inwardly through the cylinders.

Certain aspects of the present apparatus may be gleaned from PCT application AU87/00378 (W088/03444), published 19 May 1988 or its United States Counterpart, application Ser. No. 381,638, the disclosure of which is incorporated herein by reference. That specification deals with a unitary separation body over which, in certain respects, the present invention represents an improvement. First, by providing two or more individual separation bodies 10, the height of the device is reduced which means that a special building is not required to house the device. Second, the smaller, individual separation bodies are easier to support (requiring only two point support), easier to drive, are structurally stronger and are less prone to vibration. Third, because the two or more bodies are more or less the same, modularized back-up can be provided for the individual bodies as well as the conveyors, rotary knives, motors, etc. Fourth, as the separation bodies are separate, each may be provided with different mesh gauges, the first body 21 generally receiving the coarsest mesh. It will be appreciated that the mesh size of the inner and outer cylinders of each of the bodies may vary to suit the particular application.

A preferred embodiment has been described in the foregoing passages and it should be understood that other forms, modifications and refinements are feasible within the scope of this invention.

What I claim is:

1. A fibre separator comprising:

two or more perforated cylindrical enclosures each rotatable about an inclined axis;

each enclosure having an inlet at an upper end and an outlet at a lower end;

the outlet of a first enclosure feeding a conveyor which discharges into the inlet of a second enclosure;

at least one of the enclosures having at least one internal longitudinal baffle, the baffle extending radially inwardly from an internal surface of the at least one enclosure, said at least one enclosure being located concentrically within a secondary perforated cylindrical enclosure, the secondary perforated cylindrical enclosure and the at least one enclosure within it defining a gap space which discharges through an opening located adjacent to a lower imperforate end wall.

2. The separator of claim 1, wherein:

the baffle is formed from wire mesh.

3. A separator as claimed in claim 2 for use in separating bales of a crop into fibrous bark and core material, said separator further comprising shredding means for shredding the bales into a nonseparated mass and for transporting the nonseparated mass into the inlet of at least one of the enclosures for separating the nonseparated mass into said fibrous bark and core material.

4. A separator as claimed in claim 3, wherein the shredding means shreds the bales into an unseparated mass consisting essentially of three phases of materials, a first phase material consisting essentially of fibrous bark, a second phase material consisting essentially of fine particles of core material and a third phase material consisting essentially of chunks of core material, said enclosure within said secondary perforated cylindrical enclosure comprising perforations through which said second and third phase materials but not said first phase material can pass, said secondary enclosure comprising perforations through which said second phase material but not said third phase material can pass, said separator further comprising first means for recovering the third phase material passing through the perforations of said enclosure within said secondary cylindrical enclosure, and second means for recovering the second phase material passing through the perforations of both said enclosure within said secondary cylindrical enclosure, and said secondary cylindrical enclosure.

5. A method of separating fibres from an unseparated mass containing the fibres and also containing core particles, said method comprising the steps of:

loading the unseparated mass into an inlet of a first, inclined cylindrical enclosure having perforations;

rotating the first enclosure with the mass in it, the inclination and perforations of the first enclosure being such that at least some of the core particles are separated from the fibres during rotation of the first enclosure whereby there is formed a remainder of the mass which remainer contains the fibres without at least some of the core particles;

collecting the remainder of the mass exiting from an interior of the first enclosure;

conveying the remainder to an inlet of a second, inclined cylindrical enclosure having perforations;

rotating the second enclosure with the remainder in it, the inclination and perforations of the second enclosure being such that more of the core particles are separated from the fibres during rotation of the second enclosure and;

collecting a discharge exiting from an interior of the second enclosure;

wherein in at least one of the enclosures there are located one or more longitudinal baffles extending from an internal surface.

6. The method of claim 5, wherein:

at least one of the enclosures is contained concentrically within a secondary separatory enclosure, the secondary enclosure and the enclosure within it defining a gap which discharges through an opening located on a lower imperforate end wall which supports the concentric enclosures; and wherein a second discharge is collected from the opening and returned to the inlet of the first enclosure.

7. The method of claim 6, wherein:

the second discharge is further broken down with a rotary knife prior to being returned to the inlet of the first enclosure body.

8. The method of claim 5, wherein:

the one or more baffles are made from wire mesh.

9. An apparatus for grading fibrous material comprising two or more hollow bodies for rotation on inclined axes, each having a perforated wall and upper inlet and lower outlet ends, and a plurality of longitudinally extending, circumferentially spaced baffles within at least one of said bodies, the axes of the hollow bodies being inclined and the wall of each hollow body being perforated such that with rotation of each body while downwardly inclined from said inlet to said outlet ends a fibrous phase of the material is conveyed in turn to discharge from the outlet end of one body and conveyed into the inlet of another body, while a more solid phase is discharged through said perforated walls of the bodies.

10. The apparatus of claim 9, wherein:

said baffles are formed from wire mesh.

11. The apparatus of claim 9, wherein:

at least one of the bodies is located concentrically within a secondary perforated cylindrical enclosure.

12. The apparatus of claim 11, wherein:

the secondary enclosure and the body within it define a gap space which discharges through an opening located on a lower imperforate end wall which supports the concentric enclosure.

13. A separator as claimed in claim 1 for use in separating bales of a crop into fibrous bark and core material, said separator further comprising shredding means for shredding the bales into a nonseparated mass and for transporting the nonseparated mass into the inlet of at least one of the enclosures for separating the nonseparated mass into said fibrous bark and core material.

* * * * *